US012018898B2

(12) United States Patent
Graham et al.

(10) Patent No.: US 12,018,898 B2
(45) Date of Patent: Jun. 25, 2024

(54) HEAT AND MASS EXCHANGER FIN INSERTS

(71) Applicant: BLUE FRONTIER INC., Boca Raton, FL (US)

(72) Inventors: Matthew Graham, West Palm Beach, FL (US); Daniel A. Betts, Parkland, FL (US); Matthew Tilghman, Pennington, NJ (US)

(73) Assignee: BLUE FRONTIER INC., Boca Raton, FL (US)

( * ) Notice: Subject to any disclaimer, the term of this patent is extended or adjusted under 35 U.S.C. 154(b) by 25 days.

(21) Appl. No.: 17/832,021

(22) Filed: Jun. 3, 2022

(65) Prior Publication Data

US 2022/0390189 A1 Dec. 8, 2022

Related U.S. Application Data

(60) Provisional application No. 63/197,053, filed on Jun. 4, 2021.

(51) Int. Cl.
*F28F 13/06* (2006.01)
*F28F 1/20* (2006.01)

(52) U.S. Cl.
CPC ..... *F28F 13/06* (2013.01); *F28F 1/20* (2013.01); *F28F 2215/12* (2013.01); *F28F 2255/12* (2013.01)

(58) Field of Classification Search
CPC ..... F28D 3/02; F28D 3/04; F28F 2215/12; F28F 3/025; F28F 13/06; F28F 2240/00
See application file for complete search history.

(56) References Cited

U.S. PATENT DOCUMENTS 3,407,874 A * 10/1968 Gier, Jr. ..... F28F 1/126 165/171
4,076,076 A * 2/1978 Harrison ..... F24S 10/75 165/171
4,182,013 A * 1/1980 Grossman ..... F16L 3/00 165/171
4,928,756 A * 5/1990 Shull ..... F28F 1/30 165/53
5,743,330 A * 4/1998 Bilotta ..... F24D 3/141 165/171
5,942,164 A * 8/1999 Tran ..... B01D 3/20 165/60
9,982,948 B2 * 5/2018 Lee ..... F28F 1/32
(Continued)

FOREIGN PATENT DOCUMENTS

JP 2008045868 2/2008
JP 2017190928 10/2017
(Continued)

*Primary Examiner* — Devon Russell
(74) *Attorney, Agent, or Firm* — DUANE MORRIS LLP; Gregory M. Lefkowitz; Joaquin Hernandez

(57) ABSTRACT

The disclosure relates to fin inserts for heat and mass exchangers and corresponding methods. For instance, in some examples, a fin insert to a heat and mass exchanger includes a generally rigid, longitudinally-extending member that includes a top portion and side portions. The side portions may be disposed on opposite sides of the top portion, and may include a concave shape facing away from one another. The side portions may further are each be positioned around a portion of a respective heat transfer tube.

20 Claims, 7 Drawing Sheets

(56) References Cited

U.S. PATENT DOCUMENTS

| | | | | |
|---|---|---|---|---|
| 10,082,343 | B2 * | 9/2018 | Jin | F28F 1/32 |
| 2008/0110191 | A1 * | 5/2008 | Lowenstein | F28D 1/05333 62/271 |
| 2012/0199328 | A1 * | 8/2012 | Gong | F28F 1/128 29/890.03 |
| 2014/0231058 | A1 * | 8/2014 | Nakamura | F28D 5/02 165/177 |
| 2017/0198984 | A1 * | 7/2017 | Jin | F28F 17/005 |

FOREIGN PATENT DOCUMENTS

| | | | |
|---|---|---|---|
| JP | 2017190928 | A * | 10/2017 |
| KR | 20070001253 | | 1/2007 |

* cited by examiner

HEAT AND MASS EXCHANGER FIN INSERTS

CROSS-REFERENCE TO RELATED APPLICATIONS

This application claims the benefit of U.S. Provisional Patent Application No. 63/197,053, filed Jun. 4, 2021, and entitled "HEAT AND MASS EXCHANGER FIN INSERTS," which is hereby incorporated by reference in its entirety.

TECHNICAL FIELD

The disclosure relates generally to heat and mass exchangers, and more particularly, to fin inserts for heat and mass exchangers.

BACKGROUND

Heating ventilation and cooling (HVAC) systems generally cool ambient or room temperature air using a vapor compression refrigeration cycle. Less frequently, HVAC systems will include a liquid desiccant to dehumidify the air during the cooling process. In such liquid desiccant systems, many different approaches have been employed for dehumidification, cooling, as well as, for regeneration of the liquid desiccant.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
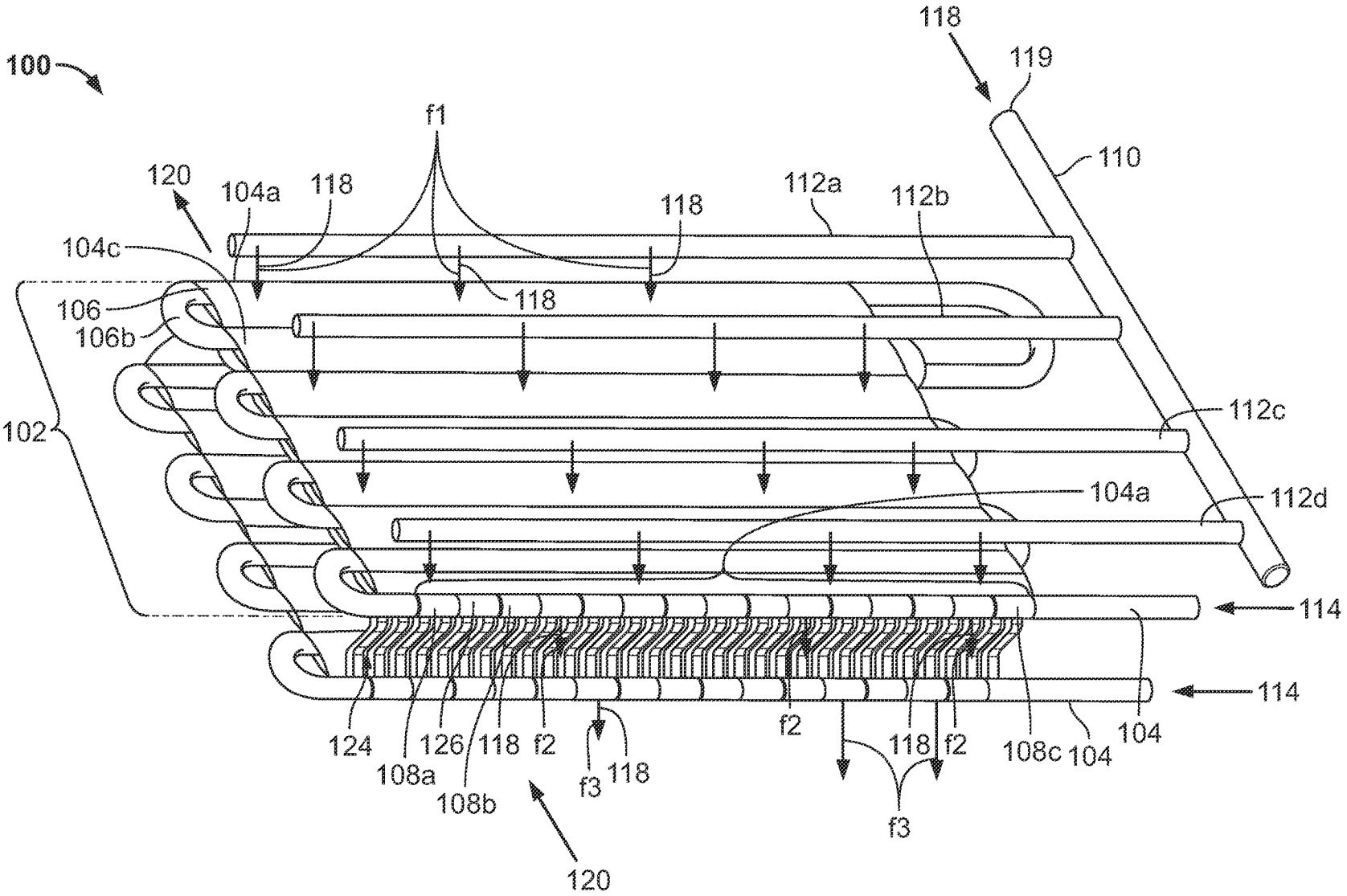
FIG. 1 illustrates an example heat and mass exchanger.

The following discussion omits or only briefly describes conventional features of heat and mass exchangers that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest reasonable interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. In the description, relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively or operably connected" is such an attachment, coupling or connection that allows the pertinent structures to operate as intended by virtue of that relationship.

Embodiments of the present disclosure relate generally to heat and mass exchangers, and more particularly, to fin inserts for heat and mass exchangers. Embodiments of the heat and mass exchanger, as well as the fin inserts, are described below with reference to FIGS. 1-5.

FIG. 1 illustrates an example heat and mass exchanger 100 (hereinafter "HMX 100"). In one or more cases, HMX 100 facilitates heat and mass transfer between at least two fluids. For example, HMX 100 may transfer water vapor (i.e., a mass) between liquid desiccant and process air stream (i.e., fluids) and regulate heat exchange between the fluids. As described herein, the HMX 100 is configured as, for example, a regenerator. However, it should be understood that the HMX 100 may be configured as a conditioner utilizing one or more of the embodiments discussed herein.

In one or more cases, HMX 100 includes one or more heat transfer assemblies 102 and a distribution manifold 110. For the cases in which the HMX 100 is configured to dehumidify, the HMX 100 includes wicking media 124 disposed between adjacent heat transfer assemblies 102. Wicking media 124 may be, for example, a three dimensional product that has different cross sections depending on where its cut, such as CELdek® evaporative cooling media. For cases in which one heat transfer assembly 102 is utilized, wicking media 124 is disposed on a side of the heat transfer assembly 102 opposite the liquid desiccant receiving side of the heat transfer assembly 102. For the cases in which the HMX 100 is configured to humidify, such as the HMX 100 illustrated in FIG. 1, the HMX 100 includes wicking media 124 disposed between adjacent heat transfer assemblies 102. Although the HMX 100 is described herein as including wicking media 124 for cases in which the HMX 100 is configured to dehumidify or humidify, it should be understood that in some cases, the wicking media 124 may not be included in the HMX 100.

The distribution manifold 110 may be a tubular member configured to pass a fluid from a receiving end of the distribution manifold 110 through one or more outlets located on distribution tubes 112 of the distribution manifold 110. For example, the distribution manifold 110 may deliver liquid desiccant 118 to distribution tubes, such as distribution tubes 112*a*, 112*b*, 112*c*, 112*d*, which then release the liquid desiccant 118 through outlets in the distribution tubes and over the heat transfer assembly 102. In some cases, the liquid desiccant 118 falls, via gravity, directly onto a surface of the heat transfer assembly 102, for example, an outer surface of a fin insert 106. In other cases, wicking media 124 may be disposed between the outlets 112 of the distribution manifold 110 and a side of the heat transfer assembly 102 facing the outlets 112. In such cases, the liquid desiccant 118 falls onto and passes through the wicking media 124 before passing through the heat transfer assembly 102. In some cases, the distribution manifold 110 receives the liquid desiccant 118 from a reservoir (not shown) configured to store the liquid desiccant 118. The distribution tubes 112 may extend perpendicularly outwards from the distribution manifold 110 and over an area of the heat transfer assembly 102. It should be noted that any number of distribution tubes 112 and outlets may be used to distribute a fluid over the heat transfer assembly 102. Further, although the distribution tubes 112 are illustrated as linearly extending over the heat transfer assembly 102, the distribution tubes 112 may be configured in other shapes, for example, but not limited to, a "S" shape, to facilitate the distribution of the liquid over the heat transfer assembly 102.

The heat transfer assembly 102 includes a heat transfer tube 104 configured to pass a heat exchange fluid 114 therein and a fin insert 106 disposed between two sections of the heat transfer tube 104, which may be parallel to one another. The heat exchange fluid 114 may be, for example, but not limited to, water, a water and glycol mixture, another refrigerant, and other like heat exchange fluids. In some cases, the heat transfer assembly 102 includes a plurality of spacers 108, such as spacers 108*a*, 108*b*, 108*c*, coupled to a section of the heat transfer tube 104, as shown in FIG. 1. In other cases, the spacers 108 may be integrated into the fin insert 106 as a ridge 208 protruding from an outer surface of the fin insert 106, such as the fin insert 206 in FIG. 2C. In either case, the spacers 108 may be periodically disposed along the section of the heat transfer tube 104, and in between the heat transfer tube 104 and the fin insert 106. The spacer 108 is formed to create and/or maintain a gap 126 between the heat transfer tube 104 and the fin insert 106 to allow a fluid, such as liquid desiccant 118, to pass from one side of the heat transfer assembly 102 to an opposite side of the heat transfer assembly 102. In one or more cases, the gap 126 may range from 1 thousandth of an inch to 100 thousandths of an inch, and more preferably, may range from 5 thousandths of an inch to 25 thousandths of an inch. In one or more cases, the thickness of the spacers 108 may be uniform to create the same size gaps 126 between the heat transfer tube 104 and the fin insert 106 of the HMX 100. In one or more other cases, to vary the flow rate or distribution of the liquid desiccant 118 between heat transfer assemblies 102, the spacers 108 of one heat transfer assembly 102 may be thicker or thinner than the spacers 108 of another heat transfer assembly 102, such as, but not limited to an adjacent heat transfer assembly 102. In one or more cases, the length of the spacers 108 may be uniform. In some other cases, a ratio of total spacer length to the length of the fin insert 106 can be less than 0.5:1, or less than 0.4:1, or less than 0.25:1. This means that the total length of a fin insert 106 with a gap 126 for liquid flow is greater than 50%, or greater than 60%, or greater than 70% of the length of the fin insert 106.

In some cases, the heat transfer tube 104 is one continuous tubular member formed in an array of longitudinal sections, such as sections 104*a* and 104*c*, spaced apart from one another via a curved section, such as curved section 104*b*. The longitudinal sections can be arranged parallel to one another. The longitudinal sections and curved sections may form an "S" like repeating pattern. In some cases, such as that shown in FIG. 1, the heat transfer tube 104 of one heat transfer assembly 102 may connect to the heat transfer tube 104 of another heat transfer assembly 102, such that the heat exchange fluid 114 may pass from one heat transfer assembly to another heat transfer assembly 102. It is noted that the heat transfer tube 104 is shown in a cylindrical shape; however, it should be understood that the heat transfer tube 104 may be formed in any other shape that can pass the heat exchange fluid 114 therein. Further, although the heat transfer tube 104 is illustrated as having eight longitudinal sections and seven curved sections, it should be understood that the heat transfer tube 104 can have any number of longitudinal sections and curved sections.

The liquid desiccant 118 may flow through the distribution manifold 110 to the outlets of the distribution tubes 112. The liquid desiccant 118 may travel downwards in a direction F1 towards a first heat transfer assembly 102 and contact an outer surface of the heat transfer assembly 102, for example, a fin insert 106. The liquid desiccant 118 may travel from the fin insert 106 into a gap 126 formed by a portion of the fin insert 106 and a heat transfer tube 104. As the liquid desiccant 118 travels through the gap 126, the liquid desiccant contacts a portion of the heat transfer tube 104 and is cooled as the liquid desiccant flows along the gap 126. The liquid desiccant 118 may pass through the first heat transfer assembly 102 to either a wicking media or to a subsequent heat transfer assembly 102, as shown in a direction F2. A process air stream 120 passes from one side of the heat transfer assemblies 102 to another side of the heat transfer assemblies 102. For example, the process air stream 120 may pass through an area, for example, between two heat transfer assemblies 102, in which the liquid desiccant 118 has been cooled. As the process air stream 120 passes through the area, the process air stream 120 may contact the cooled liquid desiccant 118, which absorbs the heat and water vapor from the process air stream 120. The process air stream 120 may exit the HMX 100 with lower water content. It is noted that FIG. 1 illustrates the process air stream 120 passing horizontally across the heat transfer assemblies 102, but it should be understood that the process air stream 120 may pass across the heat transfer assemblies 102 in any direction or any combinations of directions, such as vertically and/or diagonally. The liquid desiccant 118 may travel to the next heat transfer assembly 102, and pass through the gap 126 of the next heat transfer assembly 102. The liquid desiccant 118 is again cooled by the heat transfer tubes 104, and absorbs heat and water vapor from the air process stream 120 as the liquid desiccant 118 falls downward. This process of cooling the liquid desiccant 118 and absorbing the heat and water vapor from the process air streams 120 continues through each heat transfer assembly 102 of the HMX 100. Upon passing through the last of the heat transfer assemblies 102 and the liquid desiccant 118 reaching the bottom of the HMX 100, via passing through gaps 126 in the last of the heat transfer assemblies 102 or the wicking media 124, the liquid desiccant 118 is collected and delivered to the regenerator to be recharged.

Figure 2A:
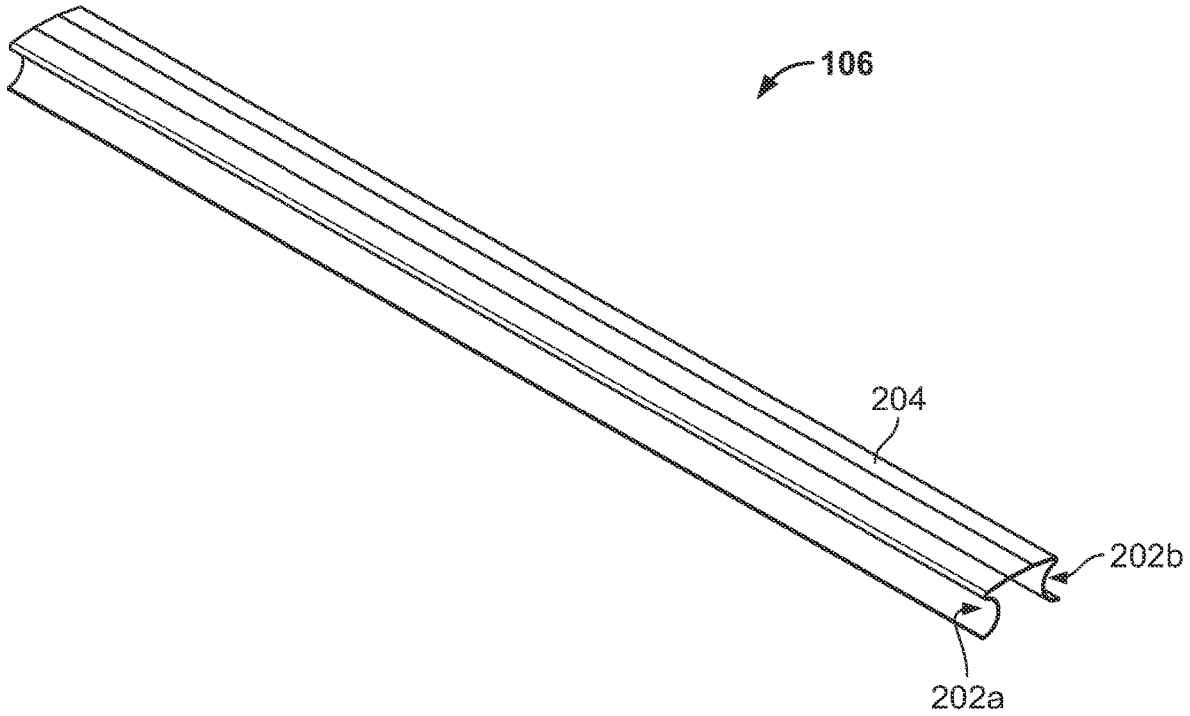
FIG. 2A illustrates a perspective view of an example fin insert.
Figure 2B:
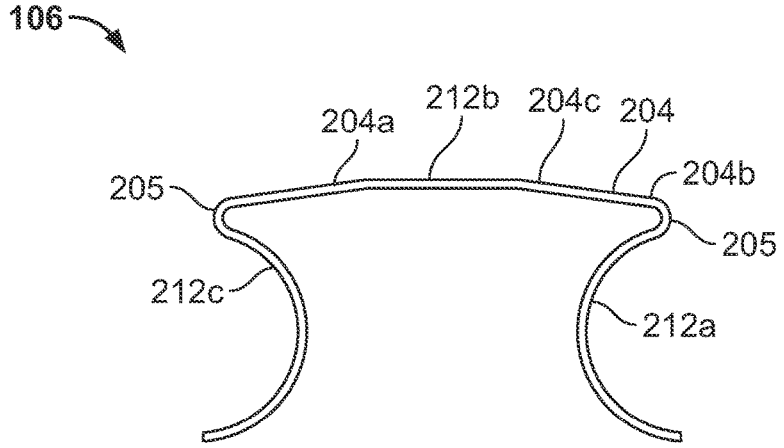
FIG. 2B illustrates a sectional view of the fin insert of FIG. 2A.

FIG. 2A illustrates a perspective view of the fin insert 106. FIG. 2B illustrates a sectional view of the fin insert 106. In one or more cases, the fin insert 106 is configured to fit in between two longitudinal sections 104*a* of two adjacent heat transfer tubes 104. The adjacent heat transfer tubes 104 can be parallel or essentially parallel. The fin insert 106 may be a generally rigid, longitudinally-extending member that includes a top wall 212*b* and side walls 212*a*, 212*c* disposed on opposite edges of the top wall 212*b*. The top wall 212*b* can have a generally peaked or convex shape, while the side walls 212*a*, 212*c* can be concave. In one or more cases, the fin insert 106 is made of a material having high thermal conductivity, for example, but not limited to, copper, steel, aluminum, titanium, platinum, and other like metals and alloys. In one or more other cases, the fin insert 106 is made of plastic or other like material having thermal conductivity properties. In one or more cases, the fin insert 106 extends from one end of the heat transfer assembly 102 to another end of the heat transfer assembly 102. For example, a fin insert 106 may extend from an end of a longitudinal section 104*a* of a heat transfer tube 104 to an opposite end of the longitudinal section 104*a* of the heat transfer tube 104.

In some cases, at least a portion of an outer surface 204 of the top wall 212*b* may be curved or angled (peaked or convex) such that the liquid desiccant 118 that contacts the outer surface 204 of the fin insert 106 is directed to flow towards one of the side walls 212*a*, 212*c*, which form a gap 126, as described above. For example, as illustrated in FIG. 2B, the top wall 212*b* may include a planar outer surface portion 204*c* disposed in between curved outer portions 204*a* and 204*b*. The curved outer portions 204*a* and 204*b* may be angled or curved downwards, such that liquid desiccant 118 flows onto side walls 212*a* and 212*c*. In another example, the outer surface 204 of the top wall 212*b* may be uniformly curved (e.g., convex) across the entire outer surface 204. In one or more cases, the outer surface 204 of the fin insert 106 may be modified to enhance the heat transfer properties of the fin insert 106. For example, the outer surface 204 may be knurled, stamped, coated in a thermally conductive material, or treated by another process that enhances the heat transfer properties of the fin insert 106.

In one or more cases, a transition section 205 may be disposed between an edge of the top wall 212*b* and a proximal edge of a side wall, such as side wall 212*a*. The transition section 205 may be formed in any shape, for example, in a curved shape, to guide the liquid desiccant 118 into the gap 126. In one or more cases, the side walls 212*a*, 212*b* are each formed to fit around a portion of a respective heat transfer tube 104. For example, the side walls 212*a*, 212*b* may have a curved shape (e.g., concave) sized to receive a portion of the heat transfer tube 104. Although the side walls 212*a*, 212*b* are illustrated as having a curved shape, it should be noted that the side walls 212*a*, 212*b*, may be formed in other shapes, such as oblong, hexagonal, and the like. In one or more cases, the side walls 212*a*, 212*b* are each formed to receive a spacer 108 therein. As described herein, one or more spacers 108 may be positioned along the longitudinal section of a heat transfer tube 104. The spacer 108 may be secured to the heat transfer tube 104, such that the spacer 108 does not move along the heat transfer tube 104. A portion of the side wall, such as side wall 212*a*, may rest on the spacer 108, thereby spacing another portion of the side wall, not in contact with the spacer 108, away from the outer surface of the heat transfer tube 104. By using the one or more spacers 108 to space the side wall of the insert fin 106 away from the heat transfer tube 104, one or more gaps 126 are formed between the side wall and the heat transfer tube 104 in the areas that do not include the spacers 108. In one or more cases, two spacers 108 may be positioned on the longitudinal section of the heat transfer tube 104, such that each spacer 108 is positioned on opposite ends of the fin insert 106. The end spacers 108 may be configured to direct the liquid desiccant 118 to flow away from the ends of the fin insert 106 and towards the gap 126.

Figure 2C:
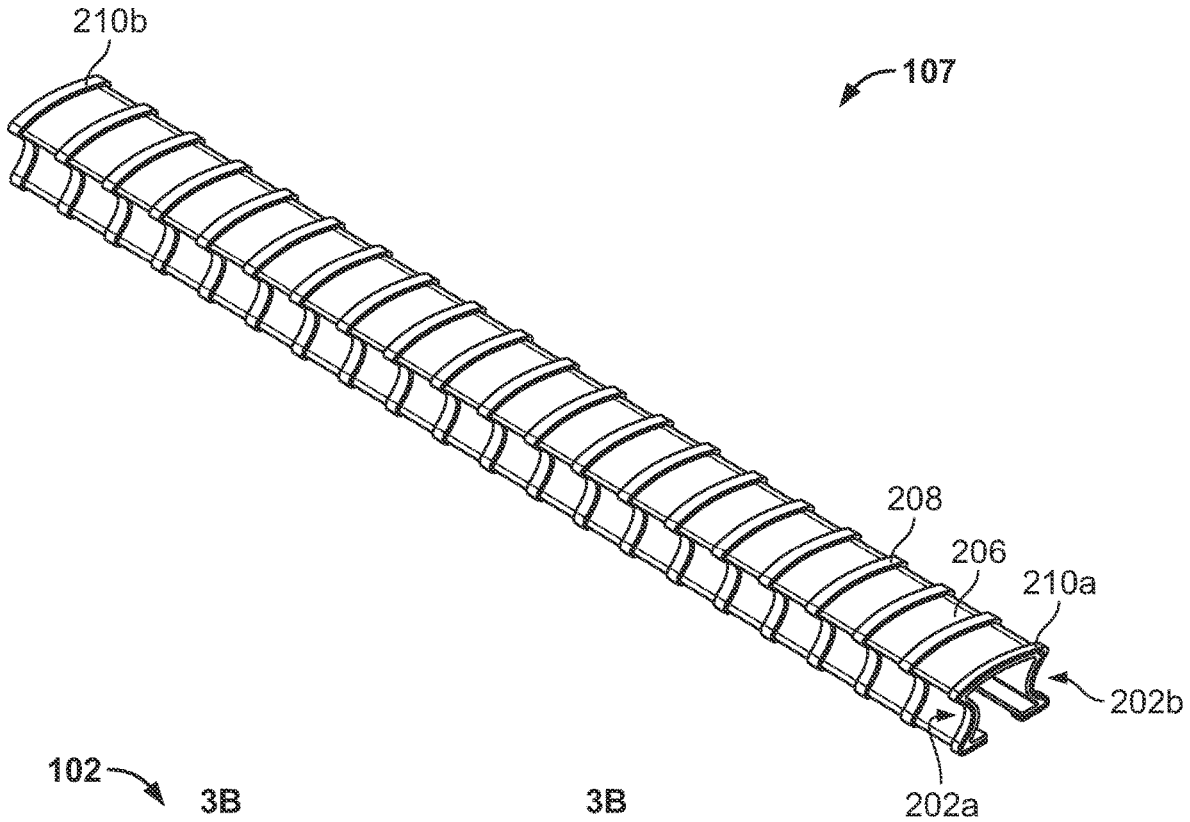
FIG. 2C illustrates a perspective view of another example fin insert.

In one or more cases, the one or more spacers 108 may be integrated as ribs 208 into the fin insert, such as the fin insert 107 illustrated in FIG. 2C, to form a unitary body. The ribs 208 may protrude from the outer surface 206 of the fin insert 107, and may be periodically formed or placed along the length of the fin insert 107. The ribs 208 may be formed in a same or similar shape as the outer surface 206 of the fin insert 107. In one or more cases, the fin insert 107 includes end ribs 210*a*, 210*b* positioned on opposite ends of the fin insert 107. The end ribs 210*a*, 210*b* may be configured to guide the liquid desiccant 118 towards the gap 126 and prevent the liquid desiccant 118 from falling over an end of the fin insert 107. It is noted that, with the exception of the integrated ribs 208, fin insert 107 includes one or more of the same or similar features of fin insert 106, and as such, a description of those features is not repeated.

Figure 3A:
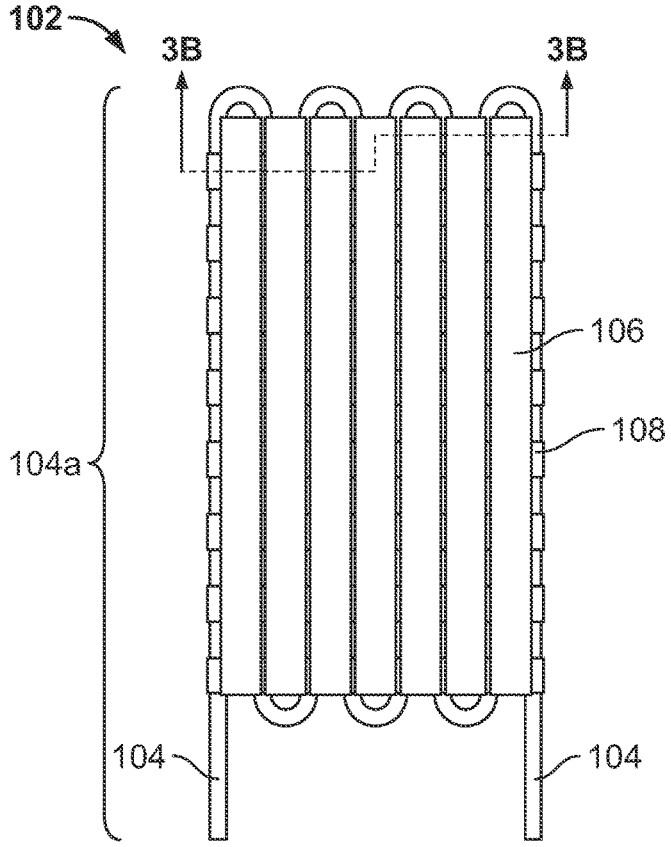
FIG. 3A illustrates a top view of an example heat transfer assembly depicted in FIG. 1.
Figure 3B:
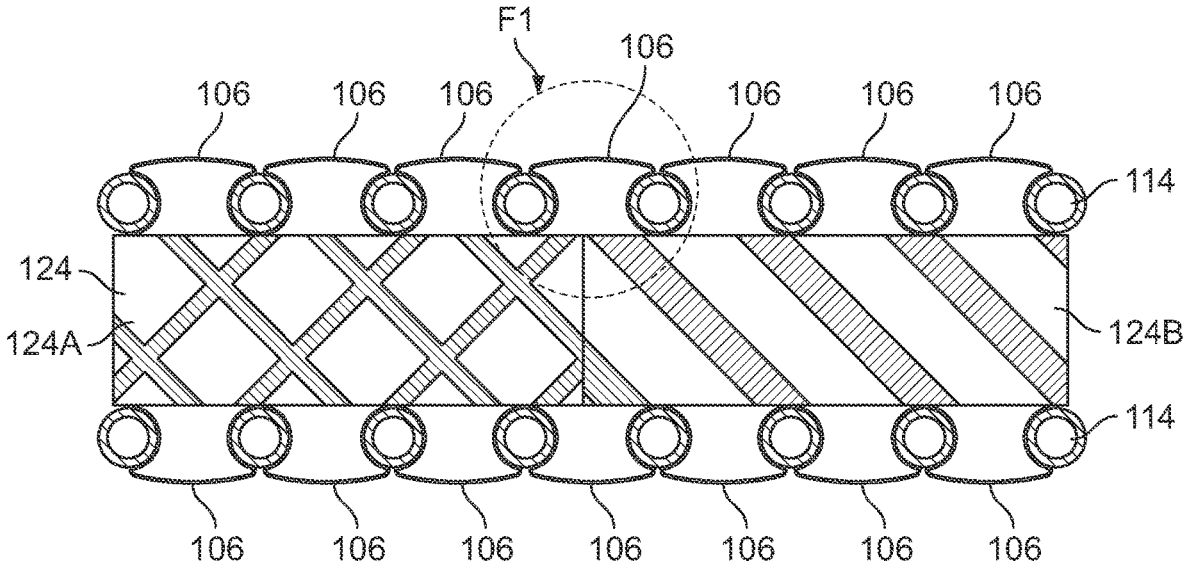
FIG. 3B illustrates a cross-sectional view of the heat transfer assembly depicted in FIG. 3A.
Figure 3C:
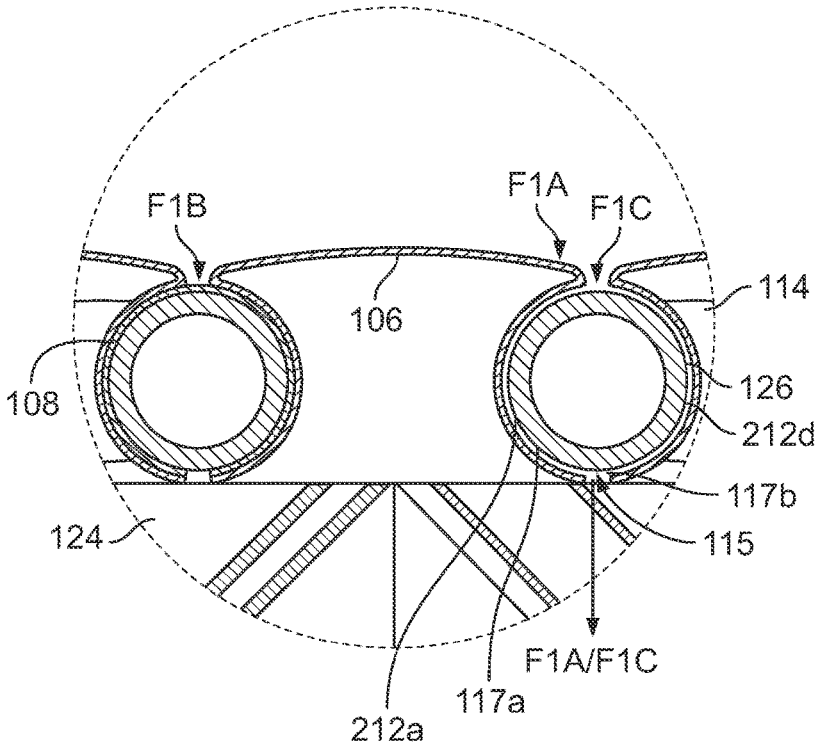
FIG. 3C illustrates an enlarged view of detail B highlighted in the cross-sectional view of the heat transfer assembly depicted in FIG. 3B.
Figure 3D:
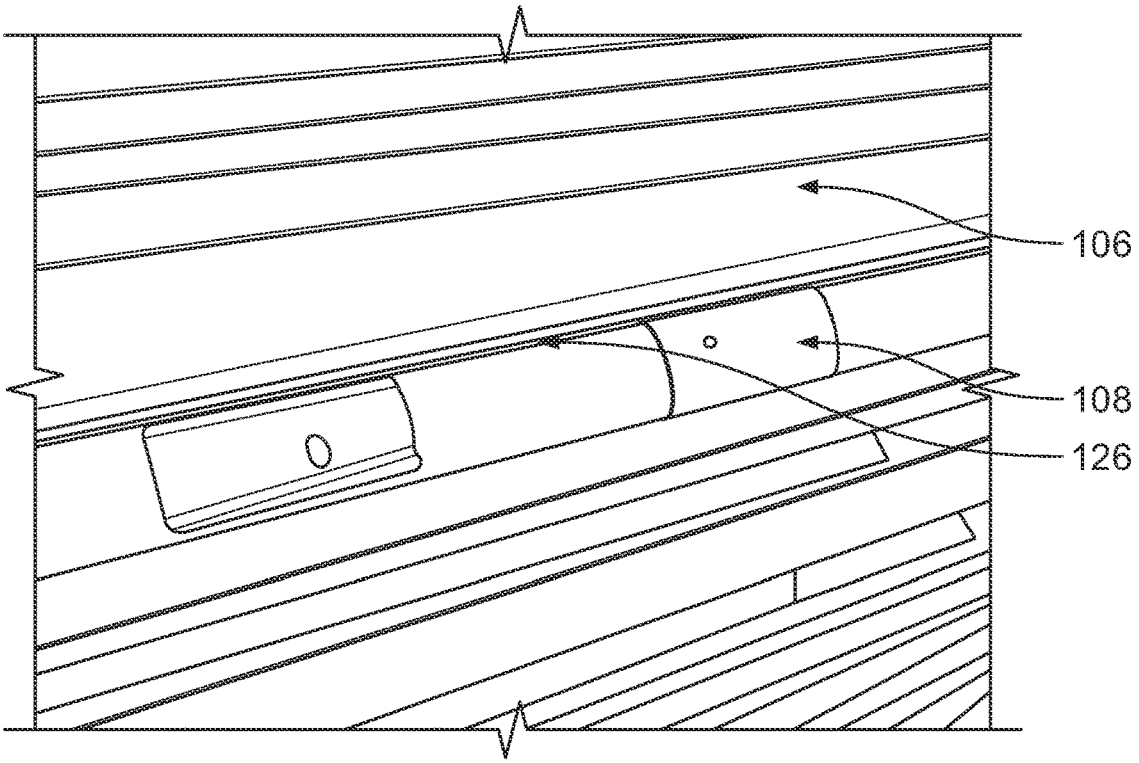
FIG. 3D is a side perspective view of the fin insert and heat transfer tube depicted in FIG. 3A.
Figure 3E:
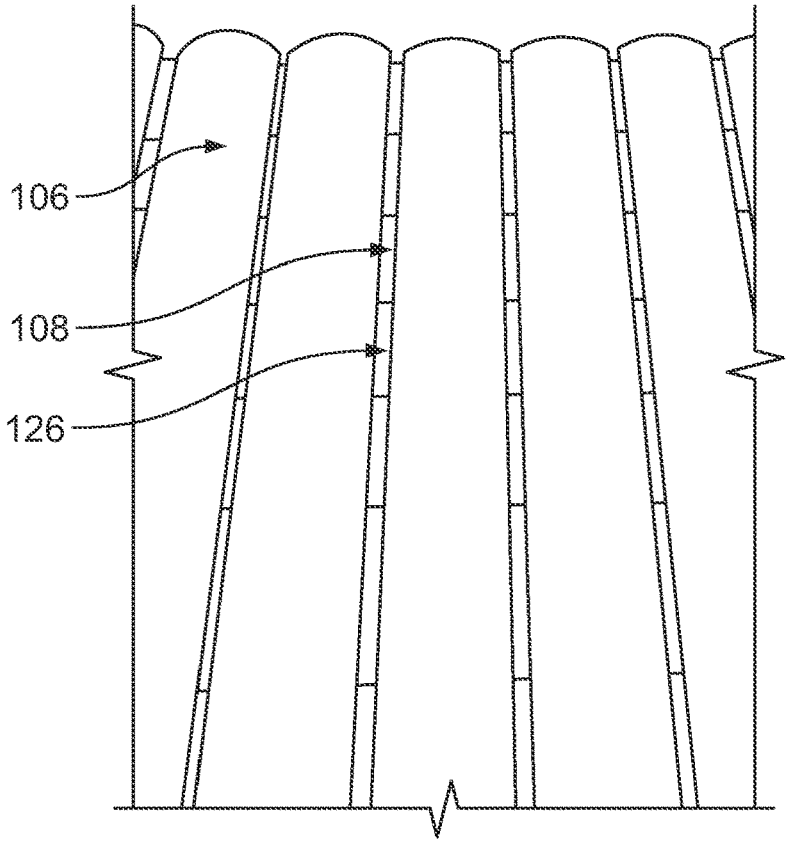
FIG. 3E is another top view of the fin insert and heat transfer tube depicted in FIG. 3A.

FIG. 3A illustrates a top view of the heat transfer assembly 102. FIG. 3B illustrates a cross-sectional view of the heat transfer assembly 102 of FIG. 3A taken along cut-line 3B-3B. FIG. 3C illustrates an enlarged view of detail F1 highlighted in the cross-sectional view of the heat transfer assembly 102 depicted in FIG. 3B. FIG. 3D is a side perspective view of the heat transfer assembly 102. FIG. 3E is another top view of the heat transfer assembly 102.

In one or more cases, the spacers 108 may be spaced along the heat transfer tubes 104 to separate and create one or more gaps 126 between the fin inserts 106 and the heat transfer tubes 104. In some cases, the spacers 108 of one heat transfer assembly 102 may be positioned over the spacers 108 of the adjacent heat transfer assembly 102, such that the spacers 108 of each heat transfer assembly 102 are vertically aligned with one another. In other cases, the spacers 108 of one heat transfer assembly 102 may be respectively positioned in an area between the spacers 108 of the adjacent heat transfer assembly 102. For example, the spacers 108 of the one heat transfer assembly 108 may be positioned over the gaps 126 of the adjacent heat transfer assembly 102.

As discussed herein, the spacers 108 block or partially block the flow of liquid desiccant 118 from passing from one side of the heat transfer assembly 102 to the other side of the heat transfer assembly. For example, as illustrated in FIG. 3C, the spacer 108 blocks the flow direction F1B of liquid desiccant 118, preventing the liquid desiccant 118 from flowing to the opposite side of the heat transfer assembly 102 in the area of the spacer 108. The HMX 100 may include vertical walls positioned on the ends of the longitudinal sections of the heat transfer tubes 104, and other vertical walls positioned on the outside of each of the outer heat transfer tubes 104. The HMX 100 may use the vertical walls to encase the HMX 100. In one or more cases, spacers 108 may be positioned on the ends of the longitudinal section of the heat transfer tubes 104 that are adjacent to the vertical walls. The spacers 108 positioned on the ends of the heat transfer tubes 104 may be used to prevent liquid desiccant 118 from flowing downward along an inner facing surface of the vertical wall.

The gap 126, created by the spacers 108, allows the liquid desiccant 118 to flow from one side of the heat transfer assembly 102 to the other side of the heat transfer assembly. For example, as illustrated in FIG. 3C, the liquid desiccant 118 that contacts the outer surface of the fin insert 106 may flow in direction F1A from the outer surface of the fin insert 106 and into the gap 126. In another example, the liquid desiccant 118 may flow in direction F1C directly into the gap 126. As the liquid desiccant 118 flows through the gap 126, the liquid desiccant 118 contacts the outer surface of the heat transfer tube 104, which cools or heats the liquid desiccant 118. That is, the gap 126 directs the liquid desiccant 118 to flow around the heat transfer tube 104, ensuring optimal contact time of the liquid desiccant 118 with the heat transfer tube 104. In one or more cases, the gap 126 enables optimization of the fluid flow pattern onto the heat transfer tubes 104, by moving from an external slug flow to an internal sheet flow. In one or more cases, the cooled or heated liquid desiccant 118 may exit the gap 126 at the opening 115 and fall downwards to the wicking media 124 which, as illustrated, includes a first cross-section 124A and a second cross-section 124B. As the fin inserts 106 and gap 126 direct the flow of the liquid desiccant 118, the HMX 100 may utilize standard wicking media inserts that do not have to be re-designed to distribute the liquid desiccate 118 onto the heat transfer tubes 104. As such, the fin inserts 106 and gap 126 may prevent significant amounts of the desiccant 118 bypassing the heat transfer tubes 104. In one or more other cases, the cooled or heated liquid desiccant 118 may exit the gap 126 at the opening 115 and fall downwards to the next heat transfer assembly 102. The end 117*a* of the sidewall 212*a* of one fin insert 106 and the end 117*b* of the sidewall 212*d* of an adjacent fin insert 106 may form the opening 115 of the gap 126. In some cases, the opening 115 may be positioned over a gap 126 in a lower adjacent heat transfer assembly 102, such that the liquid desiccant 118 is directed to flow into the gap 126 of the lower adjacent heat transfer assembly 102.

In one or more cases, the flow rate of the liquid desiccant 118 and distribution of the liquid desiccant 118 along the surface of a heat transfer tube 104 may be varied based on, for example, one or a combination of the thickness of the spacers 108, the number or length of the spacers 108, and the distance between two adjacent fin inserts 106. For example, by increasing the thickness of the spacer 108, the size of the gap 126 increases, thereby allowing more liquid desiccant 118 to flow through the heat transfer assembly 102. In contrast, for example, by decreasing the thickness of the spacer 108, the size of the gap 126 decreases, thereby reducing the flow rate of the liquid desiccant 118 but increasing the amount of liquid desiccant 118 that contacts the surface of the heat transfer tube 104. In another example, by increasing the length or number of spacers 108 along the heat transfer tube 104, the size and/or number of gaps 126 decreases, thereby reducing the flow of liquid desiccant 118. In contrast, by decreasing the length or number of spacers 108 along the heat transfer tube 104, the size and/or number of gaps 126 increases, thereby increasing the area for liquid desiccant 118 to pass from one side of the heat transfer assembly 102 to the other side of the heat transfer assembly 102. Varying the flow rate of the liquid desiccant 118 and/or distribution of the liquid desiccant 118 may optimize the HMX 100. For example, additional thermal contact between the heat transfer tubes 104 and the fin inserts 106 may increase the overall opportunity for heat transfer. In another example, increasing the flow of liquid desiccant 118 through a smaller gap 126 may encourage sheet flow of the desiccant through the gap 126. In one or more cases, as discussed herein, the maximum total heat transfer to the flowing fluid, e.g., the liquid desiccant 118, may be optimized based on the amount of contact between the fin insert 106 and the heat transfer tube 104 compared to the amount of space remaining for the fluid to flow through the gap 126. In one or more cases, as discussed herein, the maximum temperature change to the flowing fluid, e.g., the liquid desiccant 118, may be optimized based on the amount of contact between the fin insert 106 and the heat transfer tube 104 compared to the amount of space remaining for the fluid to flow through the gap 126.

Figure 4A:
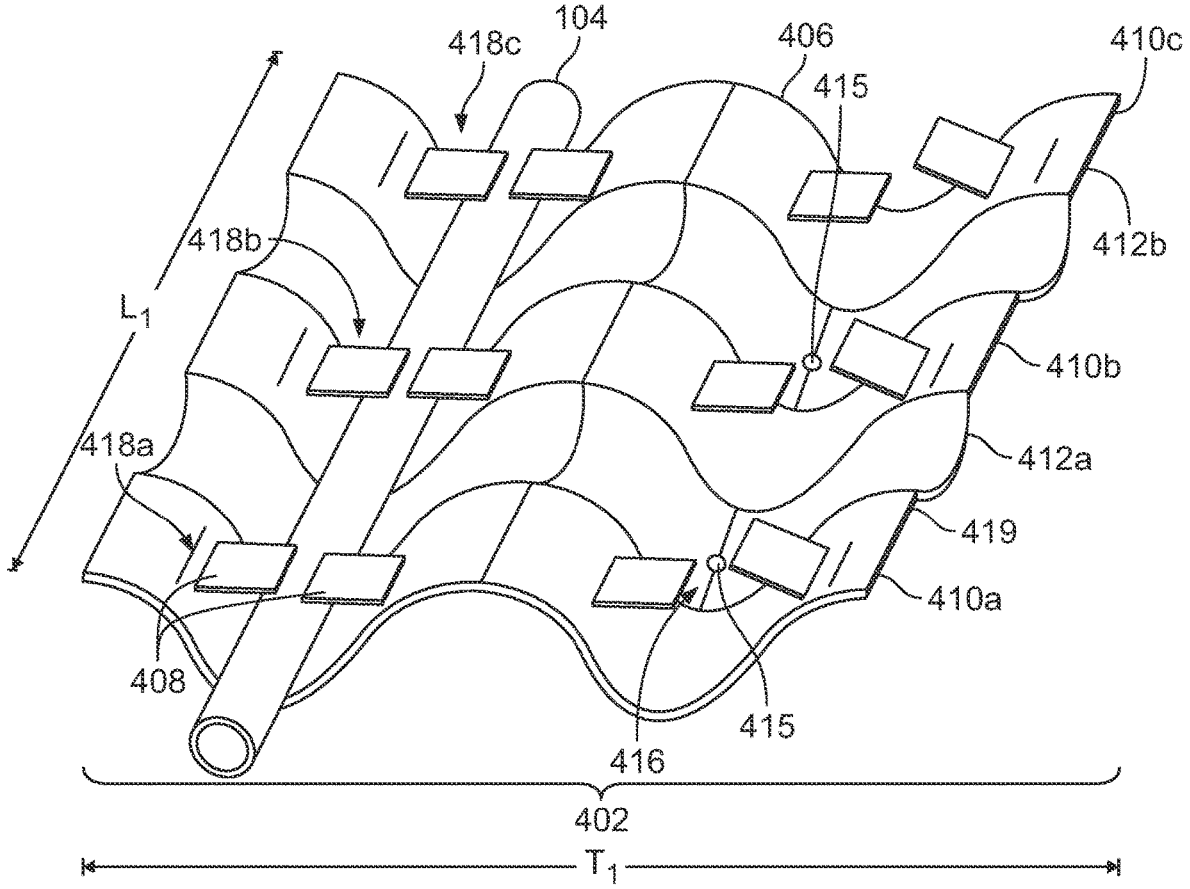
FIG. 4A illustrates a perspective view of another example heat transfer assembly.
Figure 4B:
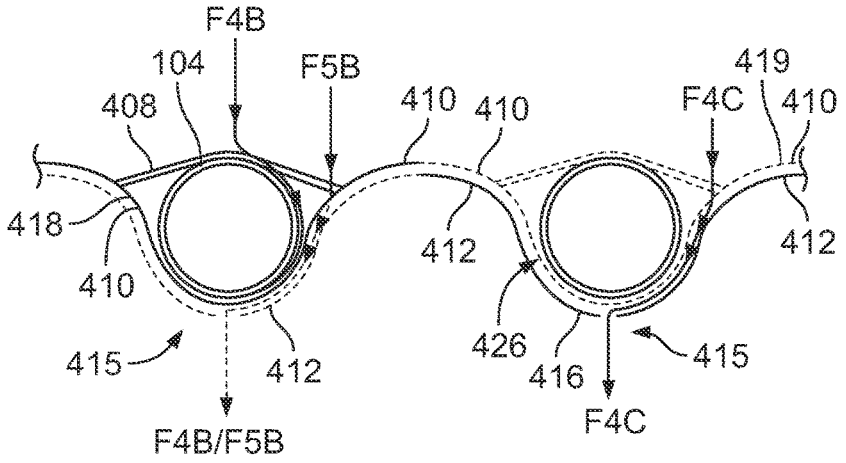
FIG. 4B illustrates a cross-sectional view of the example heat transfer assembly of FIG. 4A.

FIG. 4A illustrates a perspective view of another heat transfer assembly 402. FIG. 4B illustrates a cross-sectional view of the example heat transfer assembly 402 of FIG. 4A.

In one or more cases, the heat transfer assembly 402 includes a heat transfer sheet 406 configured to retain one or more heat transfer tubes 104. The heat transfer sheet 406 may include at least one fluid flow channel, such as fluid flow channels 412*a*, 412*b*, in which the fluid flow channel is disposed between two heat transfer tube mounts, such as heat transfer tube mounts 410*a*, 410*b*, and 410*c*. The heat transfer sheet 406 is corrugated in a longitudinal direction L1 of the heat transfer sheet 406 by a series of fluid flow channels 412*a*, 412*b* disposed between heat transfer tube mounts 410*a*, 410*b*, and 410*c*, as shown in FIG. 4A. In one or more cases, in addition to being corrugated in the longitudinal direction of the heat transfer sheet 406, the heat transfer sheet 406 is corrugated in a transverse direction Ti of the heat transfer sheet 406, such that the heat transfer tube 104 may reside at least partially within the grooves of the heat transfer sheet 406 that extend in the longitudinal direction.

The fluid flow channel, such as fluid flow channel 412*a*, may be recessed from the adjacent surfaces of the heat transfer tube mounts, such as heat transfer tube mounts 410*a* and 410*b*. Fluid flow channels 412*a*, 412*b* may be formed in any shape, such as a U-shaped valley, that guides the liquid desiccant 118 in the transverse direction of the heat transfer sheet 406 towards a drain hole 415. In one or more cases, the drain hole 415 may be located at the lowest point in the U-shaped valley of the fluid flow channel. The fluid flow channel 412*a* may include one or more drain holes 415, in which each drain hole 415 is located at the bottom 416 of each U-shaped valley. In one or more cases, the drain hole 415 may be a cut out portion of the heat transfer sheet 406. The drain hole 415 may be cut into a variety of shapes, such as, but not limited to, circular. In some cases, the portion of the heat transfer sheet 406 that surrounds the drain hole 415 may be extruded, such that the drain hole 415 forms a funnel-like shape.

In one or more cases, the heat transfer tube mounts 410 may have a curved outer surface 419 (e.g., but not limited to a convex shape), such that the liquid desiccant 118 is directed to flow towards and into an adjacent fluid flow channel. In some cases, the outer heat transfer tube mounts 410 (not shown), positioned on opposite ends of the heat transfer sheet 406, may have a curved outer surface 419

(e.g., but not limited to a concave or arc shape), such that the liquid desiccant 118 is directed to flow towards an inner adjacent fluid flow channel, and is prevented from falling over an edge of the heat transfer sheet 406.

The heat transfer tube mounts, such as heat transfer tube mounts 410*a*, 410*b*, and 410*c*, include a series of grooves, such as grooves 418*a*, 418*b*, and 418*c*, configured to receive at least a portion of the heat transfer tube 104. The grooves 418*a*, 418*b*, 418*c* may be aligned with one another in the longitudinal direction L1 of the heat transfer sheet 406. The bottom of the groove 418 may be positioned above the bottom 416 of the fluid flow channel 412. One or more of the grooves may include retention tabs 408 configured to secure the heat transfer tube 104 to the heat transfer sheet 406. In one or more cases, before installation of the heat transfer tube 104, the retention tabs 408 may be configured in an open position, in which the adjacent retention tabs 408 are bent away from one another such that the heat transfer tube 104 may be positioned on to a groove 418. Having positioned the heat transfer tube 104 onto the groove 418, the retention tabs 408 may be bent towards one another and over a portion of the heat transfer tube 104, thereby securing the heat transfer tube 104 to the heat transfer sheet 406.

In some cases, the retention tabs 408 may include the same material as the heat transfer sheet 406. In one or more cases, the retention tabs 408 may be integrally formed with the heat transfer sheet 406. For example, three sides of the retention tab 408 may be cut into the heat transfer sheet 406, and the fourth side of the retention tab 408 may remain attached to the heat transfer sheet 406 and serve as a pivot point to bend the retention tab 408 upwards or downwards. In one or more other cases, the retention tabs 408 may be a separate piece of material that is attached on a proximal end of the retention tab 408 to the heat transfer sheet 406, via adhesive, welding, bonding, fastening (e.g., via rivets, nuts and bolts, and the like), and other like attachment methods. In one or more cases, the retention tabs 408 may be used to ensure thermal contact with the heat transfer sheet 406.

In one or more cases, a fluid, such as, but not limited to, liquid desiccant 118, may fall onto the heat transfer assembly 402, and various portions of the heat transfer assembly 402 that are in contact with the liquid desiccant 118 may heat or cool the liquid desiccant 118, as the liquid desiccant 118 travels towards and through a drain hole 415 in the heat transfer sheet 406. For example, liquid desiccant 118 that contacts the heat transfer tube 104 may flow in a direction F4B over the heat transfer tube 104 and the heat transfer tube mount 410 and into an adjacent fluid flow channel 412. In another example, liquid desiccant 118 that contacts the heat transfer tube mount 410, may flow in a direction F5B over the heat transfer tube mount 410 and into the adjacent fluid flow channel 412. Having entered the fluid flow channel 412, the fluid flow channel 412 guides the liquid desiccant 118 towards a corresponding drain hole 415, and the liquid desiccant 118 may flow through the drain hole 415, and falls downward onto a wicking media insert or heat transfer assembly 402. In other examples, the liquid desiccant 118 may fall into fluid flow channel in a direction F4C, and flow towards a corresponding drain hole 415.

In one or more cases, the heat transfer sheet 406 may be produced using conventional stamping methods or a combination of roll forming or beading and stamping operations. As an example, beading rollers, such as the beading rollers illustrated in FIG. 5, may perform a beading operation on the heat transfer sheet 406 to form the fluid flow channels 412*a*, 412*b*. Subsequently, a stamping operation may be performed on the heat transfer sheet 406 to form the longitudinal grooves 418*a*, 418*b*, 418*c*. In one or more cases, the stamping operation may also simultaneously punch drain holes 415 and retention tabs 408 in the heat transfer sheet 406. In one or more other cases, sheet or coil material may be formed into the heat transfer sheet 406 using one or more stamping operations.

Figure 4C:
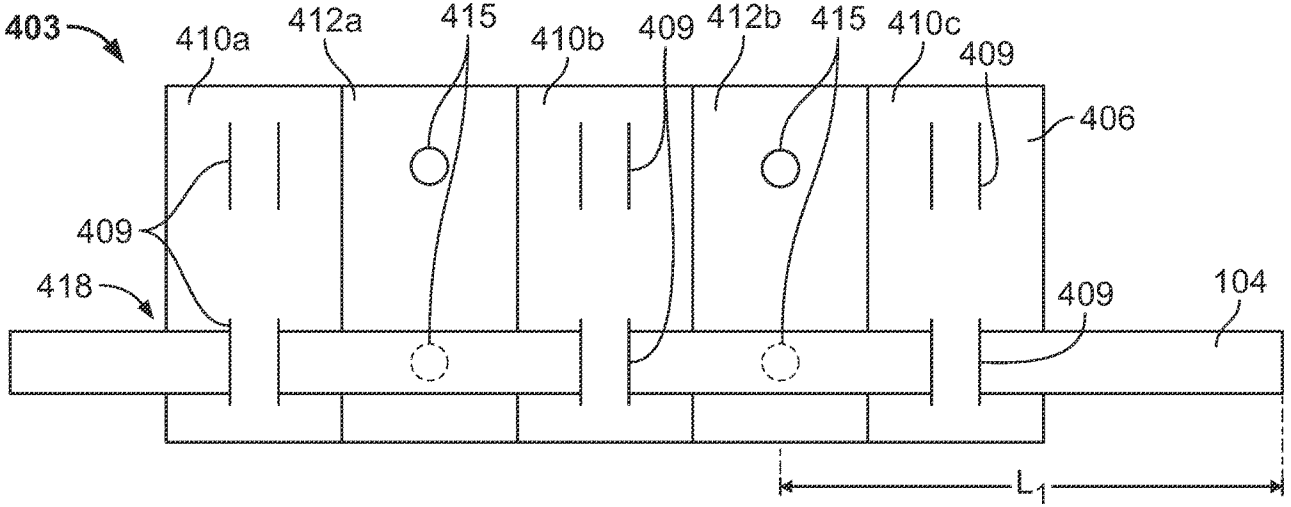
FIG. 4C illustrates a top view of another example heat transfer assembly.
Figure 4D:
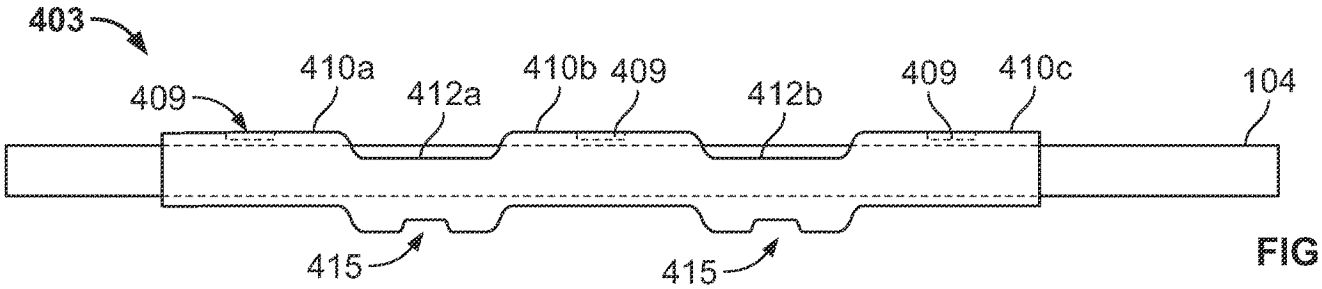
FIG. 4D illustrates a side view of the example heat transfer assembly of FIG. 4C.
Figure 5:
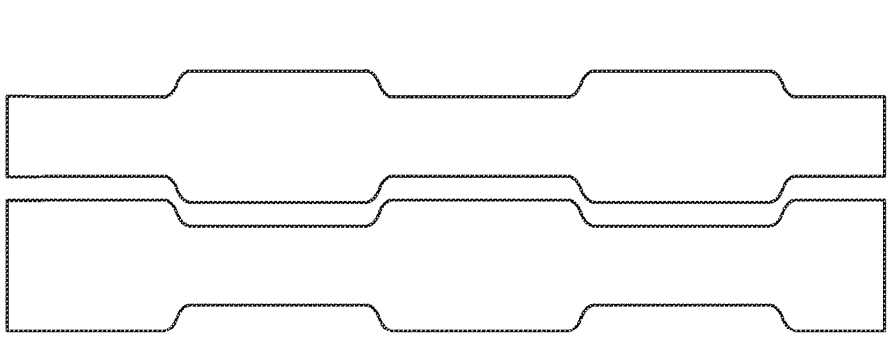
FIG. 5 illustrates a side view of example beading rollers.

FIG. 4C illustrates a top view of another example heat transfer assembly 403. FIG. 4D illustrates a side view of the example heat transfer assembly 402 of FIG. 4C. It is noted that the heat transfer assembly 403 includes one or more of the same or similar features (e.g., drawing elements having like-reference numbers illustrated in FIGS. 4A-4D) as the heat transfer assembly 402. As such, a redundant description of these features is not repeated.

In one or more cases, the heat transfer assembly 403 includes retention bridge lances 409. The lance 409 may be a rigid member that protrudes from a surface of the heat transfer sheet 406, forming a space between a bottom surface of the lance 409 and the surface of the heat transfer sheet 406. In some cases, one lance 409 is formed on the heat transfer sheet 406. In one or more other cases, a series of lances 409 are formed on the heat transfer sheet 406, such that a spaces formed by each of the lances 409 forms a channel in the longitudinal direction $L_1$ of the heat transfer assembly 403. A heat transfer tube 104 may pass under the lances 409, i.e., through the channel. Having passed the heat transfer tube 104 through the channel, one or more of the lances 409 may be staked in a secondary operation to secure the heat transfer tube 104 to the heat transfer sheet 406. By staking one or more of the lances 409, the staked lances 409 ensure thermal contact from the heat transfer tube 104 to the heat transfer sheet 406.

In some examples, a fin insert includes a generally rigid, longitudinally-extending member that includes a top portion and side portions. The side portions are disposed on opposite sides of the top portion. In addition, the side portions include a concave shape facing away from one another and are each configured to be positioned around a portion of a respective heat transfer tube.

In some examples, the top wall includes a peaked or convex shape.

In some examples, the fin insert includes a material having high thermal conductivity.

In some examples, the fin insert includes a plastic material.

In some examples, the top portion is configured in a shape such that fluid contacting an outer surface of the top portion flows towards at least one of the side portions.

In some examples, the fin insert further includes a plurality of ribs protruding from an outer surface of the fin insert. In some examples, the ribs are configured to block a flow of fluid in a vertical direction of the fin insert.

In other examples, a heat transfer assembly includes two parallel heat transfer tubes spaced apart from one another. The heat transfer assembly also includes a fin insert that includes a generally rigid, longitudinally-extending member. The generally rigid, longitudinally-extending member includes a top portion and side portions disposed on opposite edges of the top portion. The fin insert is disposed between the two parallel heat transfer tubes. The heat transfer assembly further includes a plurality of spacers disposed between the side portions of the fin insert and a respective heat transfer tube, such that the fin insert is spaced apart from the heat transfer tubes. The heat transfer assembly also includes at least one fluid channel formed between at least two spacers.

In some examples, the side portions of the fin insert include a concave shape facing away from one another and are each configured to be positioned around a portion of a respective heat transfer tube.

In some examples, the at least one fluid channel is configured to direct the flow of a fluid around a portion of a respective heat transfer tube. In some examples, the fluid includes liquid desiccant.

In some examples, the top portion of the heat transfer assembly is configured in a shape such that fluid contacting an outer surface of the top portion flows towards at least one of the side portions and into the at least one fluid channel.

In some examples, the plurality of spacers are integrally formed with the fin insert, such that the spacers protrude from an outer surface of the fin insert.

In some examples, two spacers of the plurality of spacers are disposed on opposite ends of one of the heat transfer tubes are configured to block a flow of fluid in a longitudinal direction of the fin insert.

In some examples, the fin insert includes a material having high thermal conductivity.

In some examples, a flow rate of fluid through the at least one fluid channel is varied based on one or more of a thickness of a spacer, a number of spacers disposed between the side portions of the fin insert and the respective heat transfer tube, and a length of the spacer.

In some examples, a distribution of fluid in the at least one fluid channel and along a surface of a respective heat transfer tube is varied based on a thickness of a spacer.

In some examples, the two parallel heat transfer tubes are connected to one another via a connecting tubular section, such that a heat transfer fluid may pass from one heat transfer tube to the other heat transfer tube.

In yet other examples, a method of heat transfer in a heat and mass exchanger includes passing a heat exchange fluid through two parallel heat transfer tubes of a heat transfer assembly, the heat transfer tubes being spaced apart from one another and connected via a connecting tubular section. The method also includes distributing liquid desiccant, via a distribution manifold, onto a fin insert of the heat transfer assembly, where the fin insert includes a generally rigid, longitudinally-extending member that includes a top portion and side portions disposed on opposite edges of the top portion, and the fin insert is disposed between the two parallel heat transfer tubes. Further, the method includes passing a process air stream across the heat transfer assembly and through the distributed liquid desiccant, where the distributed liquid desiccant falls onto an outer surface of the fin insert and flows towards at least one of the side portions and into at least one fluid channel defined by a cavity between at least two spacers disposed between a respective side portion of the fin insert and a respective heat transfer tube, and where the at least one fluid channel is configured to direct the flow of the liquid desiccant around a portion of the respective heat transfer tube.

In some examples, the method includes distributing the liquid desiccant from an opening of the at least one fluid channel of the heat transfer assembly onto an outer surface of a second heat transfer assembly positioned below the heat transfer assembly, where the opening of the at least one fluid channel is positioned to direct the liquid desiccant to fall towards at least one fluid channel of the second heat transfer assembly.

In other examples, a heat transfer assembly includes a generally rigid and corrugated sheet that includes a fluid flow channel disposed between two mounting portions. The heat transfer assembly also includes a heat transfer tube, a portion of which resides on least one of the two mounting portions. In addition, the fluid flow channel includes a groove of the corrugated sheet and is shaped to direct a fluid to flow towards a drain hole of the fluid flow channel, and the two mounting portions are shaped to direct the fluid to flow towards the fluid flow channel.

In some examples, the at least one of the two mounting portions include retention tabs configured to couple the heat transfer tube to the corrugated sheet.

The various embodiments described above are provided by way of illustration only and should not be construed to limit the claims attached hereto. Those skilled in the art will readily recognize various modifications and changes that may be made without following the example embodiments and applications illustrated and described herein, and without departing from the spirit and scope of the following claims.

What is claimed is:

1. A fin insert comprising:

a generally rigid member comprising a top portion and side portions, the side portions being disposed on opposite sides of the top portion, wherein the side portions comprise a concave shape facing away from one another and are each configured to be positioned to create a fluid channel around a corresponding portion of each of two horizontally adjacent heat transfer tube, wherein the generally rigid member is formed of a sheet and is elongated in an axial-direction between two horizontally adjacent heat transfer tubes.

2. The fin insert of claim 1, wherein the top wall comprises a peaked or convex shape.

3. The fin insert of claim 1, wherein the fin insert comprises a material having high thermal conductivity.

4. The fin insert of claim 1, wherein the fin insert comprises a plastic material.

5. The fin insert of claim 1, wherein the top portion is configured in a shape such that fluid contacting an outer surface of the top portion flows towards at least one of the side portions.

6. The fin insert of claim 1, further comprising a plurality of ribs protruding from an outer surface of the fin insert, wherein the plurality of ribs protrude from the side portions to contact the respective heat transfer tubes and the fluid channel extends between the heat transfer tubes and sections of the side portions between adjacent ones of the plurality of ribs.

7. The fin insert of claim 6, wherein the ribs are configured to block a flow of fluid in a vertical direction of the fin insert.

8. A heat transfer assembly comprising:

a row of at least three parallel heat transfer tubes horizontally spaced apart from one another with a fin insert disposed between adjacent pairs of the heat transfer tubes;

each fin insert comprising a generally rigid, member comprising a top portion and side portions disposed on opposite edges of the top portion, the fin insert being disposed between the two parallel heat transfer tubes;

wherein each generally rigid member is formed of a sheet and is elongated in an axial-direction between two horizontally adjacent heat transfer tubes;

a plurality of spacers disposed between the side portions of the fin insert and a respective heat transfer tube, such that the side portions are spaced apart from the heat transfer tubes; and at least one fluid channel formed between the respective side portion and heat transfer tube.

9. The heat transfer assembly of claim 8, wherein the side portions of the fin insert comprise a concave shape facing away from one another and are each configured to be positioned to create a fluid channel around a corresponding portion of each of two horizontally adjacent heat transfer tube.

10. The heat transfer assembly of claim 8, wherein the at least one fluid channel is configured to direct the flow of a fluid around a portion of a respective heat transfer tube.

11. The heat transfer assembly of claim 10, wherein the fluid comprises liquid desiccant.

12. The heat transfer assembly of claim 8, wherein the top portion is configured in a shape such that fluid contacting an outer surface of the top portion flows towards at least one of the side portions and into the at least one fluid channel.

13. The heat transfer assembly of claim 8, wherein the plurality of spacers are integrally formed with the fin insert, such that the spacers comprise a plurality of ribs that protrude from an outer surface of the fin insert, wherein the plurality of ribs protrude from the side portions to contact the respective heat transfer tubes and the fluid channel extends between the heat transfer tubes and sections of the side portions between adjacent ones of the plurality of ribs.

14. The heat transfer assembly of claim 8, wherein two spacers of the plurality of spacers are bands encircling the heat transfer tubes, wherein the two spacers are disposed on opposite ends of one of the heat transfer tubes are configured to block a flow of fluid in a longitudinal direction of the fin insert.

15. The heat transfer assembly of claim 8, wherein the fin insert comprises a material having high thermal conductivity.

16. The heat transfer assembly of claim 8, wherein a flow rate of fluid through the at least one fluid channel is varied based on one or more of a thickness of a spacer of the plurality of spacers, a number of spacers of the plurality of spacers disposed between the side portions of the fin insert and the respective heat transfer tube, and a length of the spacer.

17. The heat transfer assembly of claim 8, wherein a distribution of fluid in the at least one fluid channel and along a surface of a respective heat transfer tube is varied based on a thickness of a spacer.

18. A heat transfer assembly, comprising a generally rigid corrugated sheet; and a row of horizontally-spaced heat transfer tubes, wherein the corrugated sheet is corrugated in both an axial-direction of the heat transfer tubes and a transverse-direction of the heat transfer tubes;

wherein the corrugation in the axial-direction of the heat transfer tubes comprises mounting portion peaks and fluid flow channel grooves between adjacent mounting portions;

wherein a portion of each heat transfer tube contacts each of the mounting portions;

wherein each fluid flow channel is spaced apart from the heat transfer tube to which is it attached, and wherein each mounting portion is shaped to direct the fluid to flow towards the fluid flow channel.

19. The heat transfer assembly of claim 18, wherein at least one of the two mounting portions comprise retention tabs, wherein the retention tabs are configured to extend above the heat transfer tube to support the corrugated sheet hanging below the heat transfer tube.

20. The heat transfer assembly of claim 18, wherein each drain hole is located immediately below a heat transfer tube.

* * * * *